US008894456B2

(12) United States Patent
Bicknell

(10) Patent No.: US 8,894,456 B2
(45) Date of Patent: Nov. 25, 2014

(54) COMPOUND ROTATING HANDLE

(71) Applicant: Race Hawaii, Haleiwa, HI (US)

(72) Inventor: Lawrence Scott Bicknell, Haleiwa, HI (US)

(73) Assignees: Lawrence Scott Bucknell, Haleiwa, HI (US); David Landis Bucknell, Haleiwa, HI (US)

( * ) Notice: Subject to any disclaimer, the term of this patent is extended or adjusted under 35 U.S.C. 154(b) by 113 days.

(21) Appl. No.: 13/658,774

(22) Filed: Oct. 23, 2012

(65) Prior Publication Data

US 2013/0045099 A1 Feb. 21, 2013

Related U.S. Application Data

(63) Continuation-in-part of application No. 12/623,331, filed on Nov. 20, 2009, now Pat. No. 8,317,558.

(60) Provisional application No. 61/116,552, filed on Nov. 20, 2008.

(51) Int. Cl.
*B63H 16/04* (2006.01)

(52) U.S. Cl.
CPC ..... *B63H 16/04* (2013.01)
USPC ..... 440/101; 416/74

(58) Field of Classification Search
USPC ..... 440/101, 102, 103; 416/70 R, 72, 74
See application file for complete search history.

(56) References Cited

U.S. PATENT DOCUMENTS

| | | | | | |
|---|---|---|---|---|---|
| 2,913,727 | A | * | 11/1959 | Smith | 416/72 |
| 3,092,855 | A | * | 6/1963 | Smith | 416/72 |
| 4,701,142 | A | * | 10/1987 | Merritt | 440/101 |
| 5,265,307 | A | * | 11/1993 | Hull et al. | 16/406 |

* cited by examiner

*Primary Examiner* — Lars A Olson

(57) ABSTRACT

A paddle apparatus for standup paddling of surfboards or like water craft, having a plurality of hand grip portions rotatably mounted relative to the paddle shaft, and a means of paddling whereby the operator can ergonomically paddle with greater power and control on either side of the water craft without breaking either hand grip. A further improvement includes using the handgrip in the position perpendicular to the paddle shaft to determine the blade position by feel and steer with greater torque. An alternative embodiment includes rotation of the grip itself, further reducing the twisting of the wrists and other joints.

14 Claims, 2 Drawing Sheets

COMPOUND ROTATING HANDLE

REFERENCED APPLICATION(S)

The present application is a Continuation In Part of U.S. Utility application Ser. No. 12/623,331; filed 20 Nov. 2009 which is a Continuation of provisional patent application, Ser. No. 61/116,552; filed 20 Nov. 2008, for Compound Rotational Grip, included herein by reference and for which benefit of the priority date is hereby claimed.

BACKGROUND OF THE INVENTION

1. Field of the Invention

The present invention relates generally to an ergonomic grip for human powered propulsion through water using paddles or oars, particularly the sport of standup paddle boarding, which requires the paddler to exercise extreme angles for blade entry. More specifically the present invention relates to an improved handle system of rotating a grip having compound axis of rotation. Such a system allows a paddler to paddle on either side of a surfboard while standing with correct form for maximum power without breaking the hand grip yet exercising good ergonomic form.

2. Description of the Related Art

Paddle boarding has been a popular sport on the Hawaiian Islands for generations. Typically the surfer lays on his or her stomach to paddle, when not under wave power. Recently surfboards have been used with a paddler standing in relatively small waves, such as a bay with paddles for propelling the floating craft through water hence paddle boarding. Typically the paddles are double bladed.

It is advantageous for the blade of the paddle to enter the water directly next to the watercraft. From this more natural position the power of the stroke is greatly increased while reducing the angular torque, which tends to send the watercraft off course.

In addition, the paddler wants to minimize twisting of the torso. This unnatural twisting not only reduces efficiency, but also leads to fatigue. Over extended periods of time it can lead to repetitive strain injury to the wrists, arms, and torso.

Injuries common to prolonged double bladed paddle use include; carpal tunnel syndrome, wrist tendonitis, rotator cuff muscle tears and back strains and injuries.

One reference in the prior art is application Ser. No. 10/905,576 to Lane et al. showing a paddle attachment having a rotating grip. The present invention provides another axis of rotation to provide further relief to joints. Further, springs have been added to provide a "home position" when at the top of stroke, when the grip is horizontal.

The constant need to change and adjust the grips demonstrated in the prior art have hindered the use of a breakaway adhesive to better adhere the users hand to the paddle.

DESCRIPTION OF THIS INVENTION (ART)

Summary

The principle object of this invention is to provide an improved paddle device for standup paddling for surfboards or like water craft, having a plurality of handgrip portions rotatably mounted relative to the paddle shaft having advantage of compound rotation.

Objects and Advantages

Another objective of the invention is to introduce a rotatable handgrip which allows extra rotation to the hand grip in position roughly parallel to the shaft and stiffness to the hand grip perpendicular to the shaft.

Another objective is to provide the advantages of a single bladed "t" handle grip without the disadvantage of interference to the grip by the shaft.

It is a further objective to introduce a method of paddling incorporating advantages of both single and double bladed paddles by means of a dynamically rotating grip portion of the paddle.

In this method the operator can ergonomically paddle or maneuver using a double bladed paddle with the same motion as a "T" gripped single bladed paddle to propel the craft with greater power and accuracy with the double bladed paddle.

The operator can use this double bladed handle can be used on either side of the watercraft without breaking their hand grip by dynamically rotating the grip from one position to another.

Further this method of paddling allows more free and natural movement of the arms and torso reducing stress to the joints and muscle groups.

In addition this method of paddling allows complex maneuvers on either side of the craft quickly without breaking the hand's grip. By rotating either grip to the orthogonal position the grip becomes a lever for the paddler to know the position of the blade, which is also in the same plain as the races, and to be able to exert more force to steering or other maneuvers.

Another advantage, because the handgrip need not be broken to execute complex maneuvers, or switching sides, aids to improve the grip such as Velcro, or other chemical sticking agents, on gloves, can now be used to reduce fatigue by securing the hand to the paddle grip.

An alternative embodiment includes rotation of the grip itself allowing complex rotation and further reducing the twisting of the wrists and other joints.

A further embodiment of this invention includes a hollow diameter of shaft tubing, for improving the strength to weight ratio, larger than can easily be gripped by a person. This is because the handgrip and the shaft are no longer the same piece.

A further embodiment of the present invention includes multiple parallel shafts between the grips and/or between the grip and the paddle acting as a beam to further strengthen and stiffen the resulting structure.

With the embodiment of the parallel shafts, the grip portion may be moved up and down the beam to accommodate the needs of the paddler.

A further embodiment of this invention includes a further protection of the knuckles of the hand by a hand guard.

The foregoing has outlined rather broadly the features and technical advantages of this invention so that those skilled in the art may better understand the detailed description that follows.

Those skilled in the art will appreciate that they may readily use the conception and the specific embodiment disclosed as a basis for modifying or designing other structures for carrying out the same purposes of the present invention. Those skilled in the art will also realize that such equivalent constructions do not depart from the spirit and scope of the invention in its broadest form.

DRAWING FIGURES

Figure 4A:
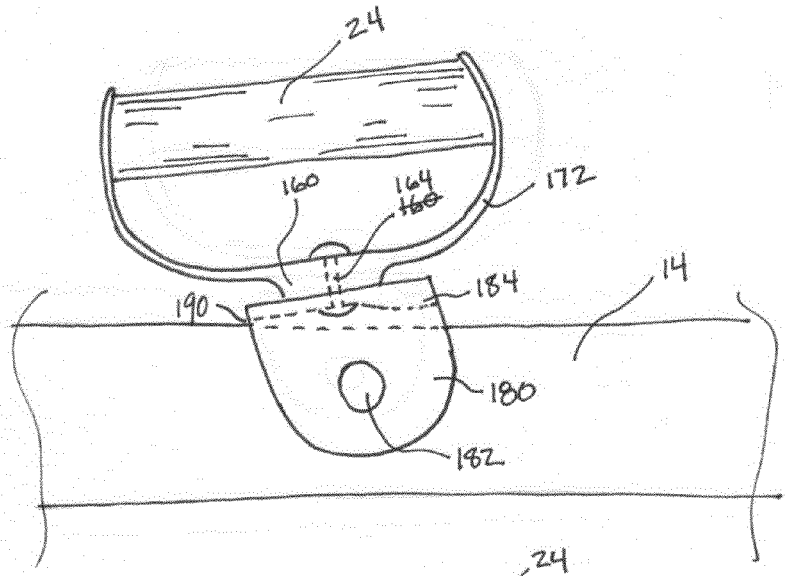

FIGS. 4*a* and B show a partially through view of an alternate embodiment of the present invention having an asymmetrical degree of angular travel.

DESCRIPTION

FIGS Preferred Embodiment

Figure 1:
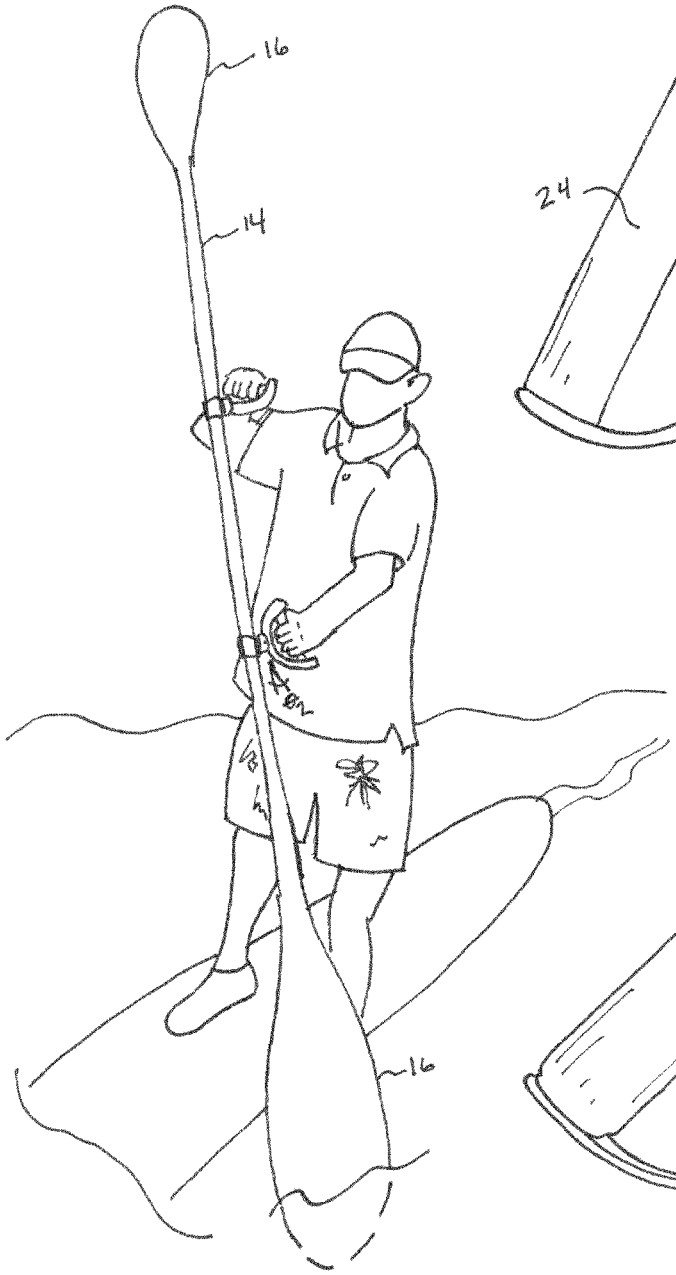
FIG. 1 shows an illustrative perspective view of a person paddling with one embodiment of the present invention.
Figure 2:
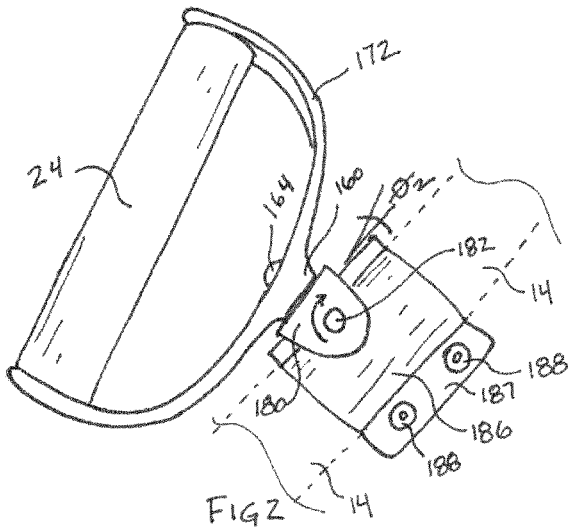
FIG. 2 shows a perspective view of one embodiment of the present invention with the grip substantially parallel with the shaft.
Figure 3:
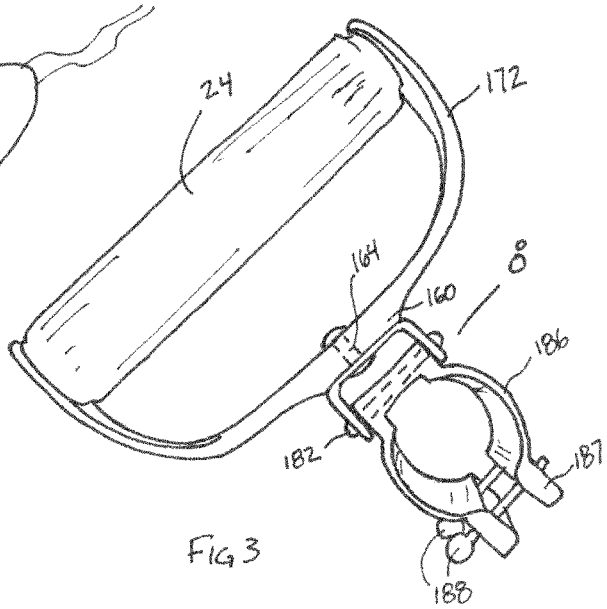
FIG. 3 shows a perspective view of the embodiment in FIG. 2 with the grip substantially perpendicular to the shaft.

FIGS. 1, 2 and 3 illustrate several advantages of the present invention. When standing while padding, the paddler's torso is positioned well above the water level requiring a steep level of entry of the paddle blade (16) and shaft (14). The d housing (172) is positioned generally orthogonally to the plane of the blade orientation (16) but can be offset, for example in an orientation known in the art as feathering. The paddler's top grip is rotated to be approximately 90° out of phase with the shaft (14) while the bottom grip is generally in phase with the shaft (14), while creating a compound angle as shown in FIG. 2 an azimuth with the plane of the paddle (16) blade. Azimuth can generally be defined as an angle being formed by a non orthogonal projection from the plane of the ring. In the present embodiment, a d frame (172) is in connection with a grip (24), and the grip (24) is sized and formed to conform with the human hand, about 12 to 14 cm inner diameter. The grip (24) has a depth to be gripped comfortably about 3.5 to 4 cm while not creating more offset than is needed for the hand to fit comfortably around the grip (24). The d frame (172) is attached to rotate about a first pivot connector (164) which is connected with a pivot mount (180) which is formed on either side of the shaft (14) or a connection collar (186) in association with the shaft (14). A second pivot connector (182) is securely connected crosswise through the shaft (14) in such a way as to form compound angles between the d frame (172) and shaft (14). While not restrictive, this particular embodiment seeks to constrain the rotation around the second pivot connector (182) to an angle (Θ2) to a predetermined angle to aid stability. It would be apparent to one skilled in the art that a return mechanism, such as a spring (not shown), can also be used to modulate travel of the wrist in a predetermined and ergonomic fashion.

Figure 4B:
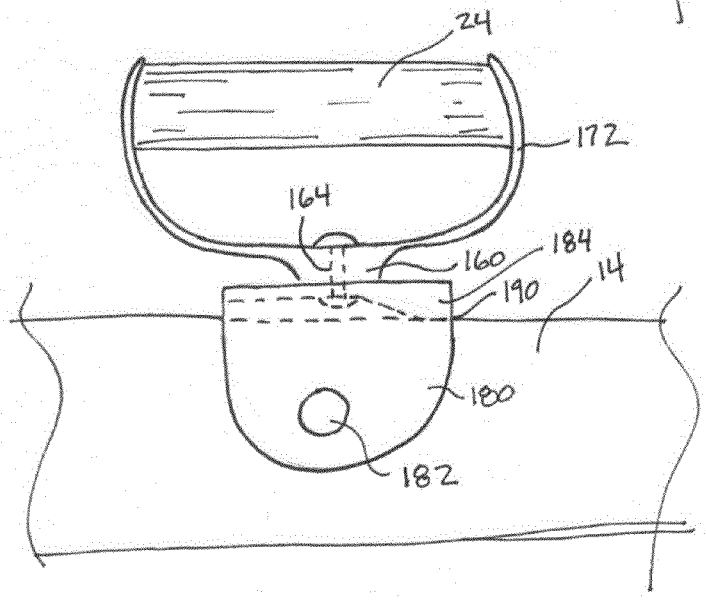

FIGS. 4A and 4B show an alternate embodiment wherein the pivot mount (180) is mounted directly to the shaft (14). It can be seen that the pivot mount (180) rotates about the second pivot connector (182) until a connection point (190) is established between the top of the pivot mount (180) and the shaft (14). In this embodiment an offset (184) is provided in order to limit the rotation of the d frame (172) in a predetermined fashion.

CONCLUSION, RAMIFICATIONS, AND SCOPE

Although the present invention has been described in detail, those skilled in the art will understand that various changes, substitutions, kiralgnev and alterations herein may be made without departing from the spirit and scope of the invention in its broadest form.

I claim:

1. An ergonomic handle system for human propulsion through water using paddles or oars having a shaft having a first end and a second end; each first and second ends having a paddle blade; a plurality of pivot mounts located at predetermined positions between the first and second ends; the pivot mounts comprising a first pivot connector being associated with a grip and a second pivot connector connected crossways through the shaft and associated with the shaft.

2. The ergonomic handle according to claim 1 wherein the first and/or second pivot connectors use ball bearings.

3. The ergonomic handle according to claim 2 wherein the first pivot connector uses ball bearings.

4. The ergonomic handle according to claim 1 further comprising a return mechanism.

5. The ergonomic handle according to claim 1 wherein the handle is made of plastic, aluminum, or wood.

6. The ergonomic handle according to claim 1 is removably attached to the shaft.

7. The ergonomic handle according to claim 6 uses a clamping mechanism to attach to the shaft.

8. The ergonomic handle according to claim 1 wherein a bottom grip is generally in phase with the shaft while creating a compound angle with the shaft.

9. The ergonomic handle according to claim 8 wherein the compound angle forms an azimuth with the plain of the paddle blade.

10. The ergonomic handle according to claim 1 wherein the rotation around the second pivot connector is constrained to a predetermined angle to aid stability.

11. An ergonomic handle system for human propulsion through water using paddles or oars having a shaft having a first end and a second end; each first and second ends having a paddle blade; a plurality of pivot mounts located at predetermined positions between the first and second ends; the pivot mounts comprising a first pivot connector being associated with a grip and a second pivot connector connected crossways through the shaft and associated with the shaft; the ergonomic handle further comprising a locking mechanism.

12. An ergonomic handle system for human propulsion through water using paddles or oars having at least one paddle; the handle system further comprising a d frame structure attached to a base member being in a secure connection with a grip; the d frame structure having a compound axis of rotation relative to the plane of the paddle blade wherein the connection is made by a pivot connector which is connected to a pivot mount which is formed on either side of the shaft, where the d frame is able to rotate or twist about the pivot connector.

13. An ergonomic handle system for human propulsion through water using paddles or oars in accordance with claim 12 wherein the base member is removably attached to a shaft.

14. The ergonomic handle system for human propulsion through water using paddles or oars in accordance with claim 13 where in the base member is held to the shaft by friction.

* * * * *